US008410718B2

(12) United States Patent
Anissimov

(10) Patent No.: US 8,410,718 B2
(45) **Date of Patent: *Apr. 2, 2013**

(54) DIMMER CONDUCTION ANGLE DETECTION CIRCUIT AND SYSTEM INCORPORATING THE SAME

(75) Inventor: Viatcheslav Anissimov, Lynn, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 322 days.

This patent is subject to a terminal disclaimer.

(21) Appl. No.: 12/788,629

(22) Filed: May 27, 2010

(65) Prior Publication Data

US 2011/0291577 A1 Dec. 1, 2011

(51) Int. Cl.
*G05F 1/00* (2006.01)

(52) U.S. Cl. ..... 315/291; 315/185 S; 315/247; 315/307; 315/DIG. 4

(58) Field of Classification Search ..... 315/177, 315/209 R, 224, 276, 291, 297, 299, 300, 315/301, 307, 308, 326
See application file for complete search history.

(56) References Cited

U.S. PATENT DOCUMENTS

| | | | | |
|---|---|---|---|---|
| 5,604,411 | A | 2/1997 | Venkitasubrahmanian et al. | |
| 6,229,271 | B1 | 5/2001 | Liu | |
| 6,486,616 | B1 | 11/2002 | Liu et al. | |
| 6,545,431 | B2 | 4/2003 | Hui et al. | |
| 6,603,274 | B2 | 8/2003 | Ribarich et al. | |
| 6,727,662 | B2 | 4/2004 | Konopka et al. | |
| 7,075,251 | B2 | 7/2006 | Chen et al. | |
| 7,528,554 | B2 * | 5/2009 | Chitta et al. | 315/291 |
| 7,852,017 | B1 * | 12/2010 | Melanson | 315/291 |
| 2009/0079367 | A1 * | 3/2009 | Crouse et al. | 315/307 |
| 2010/0060186 | A1 * | 3/2010 | Taipale et al. | 315/291 |
| 2010/0060200 | A1 * | 3/2010 | Newman et al. | 315/307 |

FOREIGN PATENT DOCUMENTS

| | | | |
|---|---|---|---|
| EP | 1128711 | A2 | 8/2001 |
| JP | 2005-197231 | A | 7/2005 |
| JP | 2007-123271 | A | 5/2007 |
| JP | 2008-270173 | A | 11/2008 |

(Continued)

OTHER PUBLICATIONS

Yeong Kyo Shin, International Search Report and Written Opinion of the International Searching Authority, Jan. 30, 2012, pp. 1-7, Korean Intellectual Property Office, Daejeon, Republic of Korea.

(Continued)

*Primary Examiner* — Shawki S. Ismail
*Assistant Examiner* — Christopher Lo
(74) *Attorney, Agent, or Firm* — Shaun P. Montana

(57) ABSTRACT

A dimmer conduction angle detection circuit, and systems and methods incorporating the same, is disclosed. The circuit receives a gate drive signal from a PFC circuit and provides a dimmer reference level signal representative of a dimmer circuit's dimmer setting in response. The circuit includes a comparator with first and second inputs that provides a pulse-width modulated output in response to comparing signals received at the inputs. The pulse-width modulated output has a pulse width representative of the dimmer circuit's dimmer setting. The circuit also includes an input network, coupled to the comparator, to receive the gate drive signal and to provide an output, in response, to the comparator's first input. The circuit also includes a threshold supply circuit to provide a threshold voltage to the comparator's second input, and a filter, coupled to the comparator, to convert the comparator's pulse-width modulated output to the dimmer reference level signal.

20 Claims, 5 Drawing Sheets

FOREIGN PATENT DOCUMENTS

| | | | |
|---|---|---|---|
| KR | 10-0594425 | B1 | 6/2006 |
| KR | 10-2009-0124728 | A | 12/2009 |

OTHER PUBLICATIONS

Claudio Adranga, Design Equations of High-Power-Factor Flyback Converters Based on the L6561, STMicroelectronics Application Note AN1059, Sep. 2003, pp. 1-20.

Claudio Adranga et al., Flyback Converters With the L6561 PFC Controller, STMicroelectronics Application Note AN1060, Jan. 2003, p. 1-11.

Luca Salati, Switching From the L6561 to the L6562, STMicroelectronics Application Note AN1757, Apr. 2004, pp. 1-9.

* cited by examiner

DIMMER CONDUCTION ANGLE DETECTION CIRCUIT AND SYSTEM INCORPORATING THE SAME

CROSS-REFERENCE TO RELATED APPLICATIONS

This application is related to co-pending U.S. patent application Ser. No. 12/788,648, having the same inventor, which was simultaneously filed on May 27, 2010, and is entitled "DIMMER CONDUCTION ANGLE DETECTION CIRCUIT AND SYSTEM INCORPORATING THE SAME". This co-pending application is hereby incorporated by reference in its entirety.

TECHNICAL FIELD

The present application relates to a dimmer conduction angle detection circuit and systems and methods incorporating the dimmer conduction angle detection circuit.

BACKGROUND

Solid state light source based lamps (including light-emitting diode (LED) based lamps) and gas discharge lamps, such as high intensity discharge (HID) and fluorescent lamps, may be used in connection with a wide variety of applications. Such lamps are typically driven by a ballast circuit. The ballast circuit typically converts an input signal to a stable direct current (DC) or alternating current (AC) voltage used to drive the lamp. The ballast circuit may, for example, incorporate a rectifier to receive an AC input and a power conversion circuit. The power conversion circuit may receive an unregulated output from the rectifier and provide a stable, regulated output to the lamp.

When it is desired to provide an adjustable output illumination level for a lamp, a dimming control circuit may be used. The dimming control circuit may receive line voltage, e.g. from a 120 VAC/60 Hz source, and provide a modified output signal to the ballast rectifier for the purpose of controlling the illumination level of the lamp. In one configuration, the dimming control circuit may be a circuit known as a "phase control" dimmer or a "phase-cut" dimmer.

In a phase control dimmer, a fraction of the input voltage sine-wave is cut in each period of the waveform, i.e. the conduction angle of the input voltage sine-wave modified. During the cut-time interval or "dead time" when the voltage is cut, the output of the phase control dimmer may be substantially zero. The residual time interval where the voltage differs from zero is known as the "dimmer conduction time." Both the dimmer conduction time and the dead time are variable, but the time period of the input voltage waveform is constant, e.g. 1/60 second in the United States. As used herein, the "dimmer setting" refers to the ratio of the dimmer conduction time to the time period of the input waveform. The dimmer setting of a phase control dimmer is controllable by a user. In one configuration, the dimmer setting may be varied from about 0.78 to about 0.25.

The ballast circuit may be configured regulate the lamp light output in response to the dimmer setting. In one configuration, the ballast circuit may include a conduction angle detection circuit for providing an output representative of the dimmer setting to the ballast power conversion circuit. The power conversion circuit may be configured to drive the lamp for establishing a lamp light output corresponding to the output of the conduction angle detection circuit.

One known phase-control dimming setting detection circuit is a simple RC filter. The rectified output of the dimming control circuit may be provided to the input of the RC filter, and the output of the filter may be a DC signal proportional to the dimmer setting signal. Although an RC filter configuration is simple, it may provide an output that is sensitive not only to the dimmer setting but also to fluctuations in the line source voltage amplitude, which may result in undesired changes in the light output at a constant dimmer setting. Also, an RC filter configuration may not provide sufficient linearity of lamp light output regulation. Another known conduction angle detection circuit incorporates a microcontroller, which adds complexity and cost to the ballast circuit.

SUMMARY

In an embodiment, there is provided a ballast circuit to drive a light source. The ballast circuit includes a rectifier circuit configured to receive an AC input voltage from a dimmer circuit and to provide a rectified output voltage; a switching converter configured to receive the rectified output voltage and provide a regulated output voltage; a power factor correction circuit configured to provide a gate drive output to control a switch of the switching converter; a power conversion circuit configured to receive the regulated output voltage and provide an output to the light source in response to the regulated output voltage and a dimmer reference level signal representative of a dimmer setting of the dimmer circuit; and a conduction angle detection circuit configured to receive the gate drive output and coupled to an input of the power conversion circuit to provide the dimmer reference level signal to the power conversion circuit.

In a related embodiment, the conduction angle detection circuit may include a comparator having a first input and a second input, the comparator configured to provide a pulse-width modulated output in response to comparison of signals at the first input with signals at the second input, the pulse width modulated output having a pulse width representative of the dimmer setting of the dimmer circuit; an input network coupled to the comparator and configured to receive the gate drive signal and to provide an output in response to the gate drive signal, wherein the input network provides the output to the first input of the comparator; a threshold supply circuit configured to provide a threshold voltage to the second input of the comparator; and a filter coupled to the comparator, the filter being configured to convert the pulse-width modulated output of the comparator to the dimmer reference level signal.

In a further related embodiment, the first input may be an inverting input of the comparator and the second input may be a non-inverting input of the comparator. In another further related embodiment, the input network may include a capacitor configured to charge during a time when the gate drive signal is at a first level and to discharge during a time when the gate drive signal is at a second level, and a voltage across the capacitor may be provided as the output to the first input of the comparator. In a further related embodiment, the input network may include a diode coupled to the capacitor, the diode being configured to block current from the gate drive signal to the first input of the comparator and to allow the capacitor to discharge during the time when the gate drive signal is at the second level. In another further related embodiment, the capacitor may be configured to charge to a voltage greater than the threshold voltage only during a dead time associated with the dimmer setting. In yet another further related embodiment, the capacitor may be configured to be charged by a supply voltage through a resistor.

In a further related embodiment, the threshold supply circuit may include first and second resistors provided in a voltage divider configuration, and the second input may be coupled between the first and second resistors. In another further related embodiment, the filter may include a second order low pass filter configuration. In yet another further related embodiment, the pulse width modulated signal may have a high voltage level limited to a DC value of a supply voltage to the comparator.

In another embodiment, there is provided a conduction angle detection circuit to receive a gate drive signal from a power factor correction circuit and to provide a dimmer reference level signal representative of a dimmer setting of a dimmer circuit in response to the gate drive signal. The conduction angle detection circuit includes a comparator having a first input and a second input, the comparator configured to provide a pulse-width modulated output in response to comparison of signals at the first input with signals at the second input, the pulse width modulated output having a pulse width representative of the dimmer setting of the dimmer circuit; an input network coupled to the comparator and configured to receive the gate drive signal and to provide an output in response to the gate drive signal, wherein the input network provides the output to the first input of the comparator; a threshold supply circuit configured to provide a threshold voltage to the second input of the comparator; and a filter coupled to the comparator, the filter being configured to convert the pulse-width modulated output of the comparator to the dimmer reference level signal.

In a related embodiment, the first input may be an inverting input of the comparator and the second input may be a non-inverting input of the comparator. In another related embodiment, the input network may include a capacitor configured to charge during a time when the gate drive signal is at a first level and to discharge during a time when the gate drive signal is at a second level, and a voltage across the capacitor may be provided as the output to the first input of the comparator. In a further related embodiment, the input network may include a diode coupled to the capacitor, the diode being configured to block current from the gate drive signal to the first input of the comparator and to allow the capacitor to discharge during the time when the gate drive signal is at the second level. In another further related embodiment, the capacitor may be configured to charge to a voltage greater than the threshold voltage only during a dead time associated with the dimmer setting. In yet another further related embodiment, the capacitor may be configured to be charged by a supply voltage through a resistor.

In a related embodiment, the threshold supply circuit may include first and second resistors provided in a voltage divider configuration, and the second input may be coupled between the first and second resistors. In another related embodiment, the filter may include a second order low pass filter configuration. In yet another related embodiment, the pulse width modulated signal may have a high voltage level limited to a DC value of a supply voltage to the comparator.

In another embodiment, there is provided a method of dimming a light source driven by a ballast. The method includes controlling a switch of a switching converter using a gate drive output of a power factor correction circuit to provide a regulated voltage output to a power conversion circuit; coupling the gate drive output to a conduction angle detection circuit, wherein the conduction angle detection circuit is configured to provide a dimmer reference level signal corresponding to a dimmer setting of a dimmer circuit in response to the gate drive output; and coupling the dimmer reference level signal to the power conversion circuit, the power conversion circuit being configured to provide an output to the light source in response to the dimmer reference level signal to establish a light output level corresponding to the dimmer setting.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
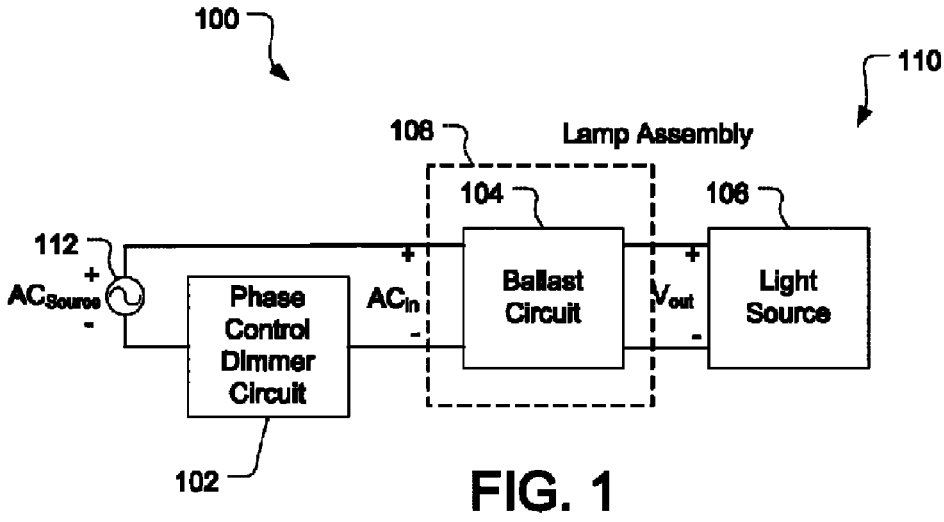
FIG. 1 is a block diagram of an embodiment as disclosed herein.

In general, circuits, systems, and methods according to embodiments described herein use the gate drive output of a power factor correction circuit to establish a signal for driving a lamp at a light output level corresponding to a dimmer setting. Power factor correction (PFC) circuits are well-known and are sometimes used in ballast configurations including switching converters. A switching converter generally includes a switch, e.g. a transistor, which is selectively operated to allow energy to be stored in an energy storage device, e.g. an inductor, and then transferred to one or more filter capacitors. The filter capacitor(s) provide a relatively smooth DC output voltage to the load, e.g. through a power conversion circuit, and provide essentially continuous energy to the load between energy storage cycles. Known switching converter configurations include, for example, buck, boost, buck-boost, fly-back, and SEPIC converters.

One issue with switching converter configurations is that they may involve a pulsed current draw from the AC power source in a manner that results in a less than optimum power factor. The power factor of a system is defined as the ratio of the real power flowing to the load to the apparent power, and is a number between 0 and 1 (or expressed as a percentage, e.g. 0.5 pf=50% pf). Real power is the actual power drawn by the load. Apparent power is the product of the current and voltage applied to the load.

For systems with purely resistive loads, the voltage and current waveforms are in phase, changing polarity at the same instant in each cycle. Such systems have a power factor of 1.0, which is referred to as "unity power factor." Where reactive loads are present, such as with loads including capacitors, inductors, or transformers, energy storage in the load results in a time difference between the current and voltage waveforms. This stored energy returns to the source and is not available to do work at the load. Systems with reactive loads often have less than unity power factor. A circuit with a low power factor will use higher currents to transfer a given quantity of real power than a circuit with a high power factor.

PFC circuits are used in some switching converter configurations to provide improved power factor. In general, the PFC circuit may be used, for example, as a controller to control operation of the transistor switch in a switching converter configuration. In one example, a PFC circuit may monitor the rectified AC voltage, the current drawn by the load, and the output voltage to the load, and provide a gate drive (GD) output signal to the transistor to switch current to the load having a waveform that substantially matches and is in phase with the rectified AC voltage.

In some PFC circuit configurations, the GD output from the PFC circuit may be maintained at a constant high level during the dimmer dead time. The time duration of the GD signal at a high voltage level thus represents dead time in the dimmer setting of a phase control dimmer. Conversely, the time that the GD signal is not maintained at a high voltage level represents the conduction time in the dimmer setting. A circuit and system according to embodiments disclosed herein take advantage of this characteristic of the GD signal to provide a voltage-limited dimmer reference level output signal to a power conversion circuit that is proportional to a dimmer setting. The power conversion circuit may be configured to drive a lamp in response to the dimmer reference level output to achieve a lamp light output corresponding to the dimmer setting. Although embodiments of a circuit and system may be described herein in connection with a PFC circuit GD signal that is maintained at a high voltage level during the dimmer setting dead time, it is not limited thereto. Indeed, those of ordinary skill in the art will recognize that a circuit and system according to the present disclosure may be used in connection with a PFC circuit GD signal that is maintained at a low voltage level during the dimmer dead time.

Turning now to FIG. 1, there is illustrated a simplified block diagram of one exemplary embodiment of a system 100. The system 100 includes a known phase control dimmer circuit 102 coupled to a lamp assembly 110 including a ballast circuit 104 and a light source 106. The term "coupled" as used herein refers to any connection, coupling, link or the like by which signals carried by one system element are imparted to the "coupled" element. Such "coupled" devices, or signals and devices, are not necessarily directly connected to one another and may be separated by intermediate components or devices that may manipulate or modify such signals. Likewise, the terms "connected" or "coupled" as used herein in regard to mechanical or physical connections or couplings is a relative term and does not require a direct physical connection.

The phase control dimmer circuit 102 may take a known configuration, such as a standard or reverse phase control dimmer provided in a wall switch, the operation of which is well-known. As described above, the phase control dimmer circuit 102 cuts a fraction of the input voltage sine-wave $AC_{Source}$ in each period of the waveform to provide an AC input $AC_{in}$ to the ballast circuit 104 having an associated dimmer setting. In some embodiments, $AC_{Source}$ may be a provided directly from a 120 VAC/60 Hz line source 112. It is to be understood, however, that a system consistent with the present application may operate from other AC sources, such as a 220-240 VAC source at 50-60 Hz.

As described in detail below, the ballast circuit 104 includes a conduction angle detection circuit to provide a voltage-limited dimmer reference level output signal in response to the dimmer setting applied by the phase control dimmer. In response to the dimmer reference level output, the ballast is configured to convert the AC input voltage $AC_{in}$ to a regulated output voltage $V_{out}$ to the light source to establish a lamp light output level corresponding to the dimmer setting. The light source may be any gas discharge lamp, such as an HID or fluorescent lamp and/or may be a solid-state-based light source, including one or more light emitting diodes (LEDs) and variations thereof (e.g., OLEDs, PLEDs, etc.). The output voltage $V_{out}$ may be an AC or DC voltage depending on the lamp configuration.

The ballast circuit 104 may be disposed within a housing 108, such as within the housing of a parabolic aluminized reflector (PAR) lamp or a compact fluorescent lamp (CFL), and the light source 106 may be electrically coupled to the ballast circuit 104 and mechanically coupled to the housing 108 to provide a lamp assembly 110. The lamp assembly 110 may be configured to mate with existing lighting fixtures, such as those configured for use with incandescent lamps, and may be inserted directly into such lighting fixtures to operate on the AC input thereto, e.g. through a dimmer circuit.

Figure 2:
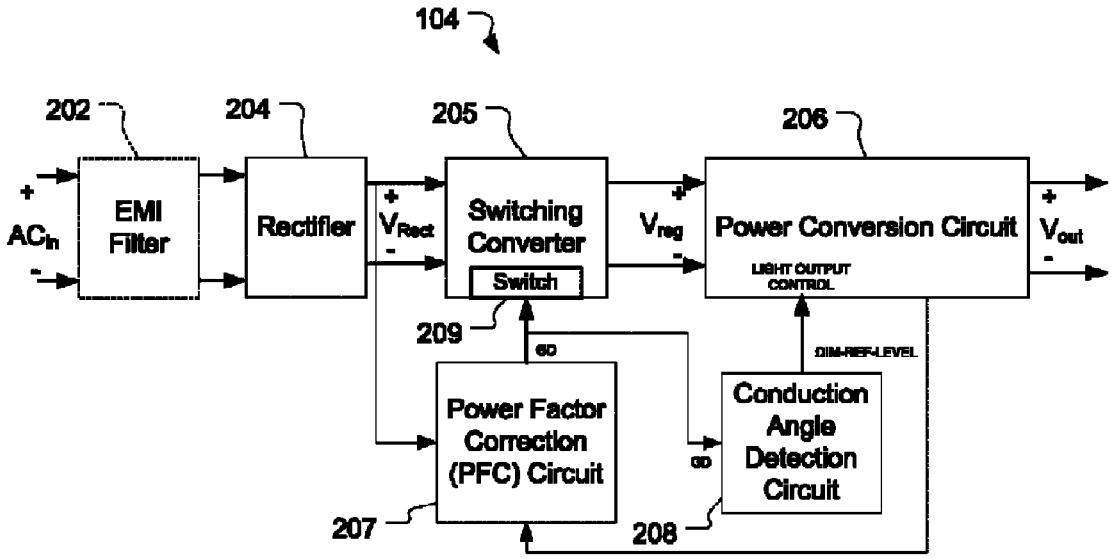
FIG. 2 is a block diagram of a ballast circuit according to embodiments disclosed herein.

FIG. 2 is a block diagram that conceptually illustrates the functionality of a ballast circuit 104. As shown, a ballast circuit 104 may include an optional electromagnetic interference (EMI) filter 202, a rectifier 204, a power factor correction (PFC) circuit 207, a switching converter 205, a power conversion circuit 206, and a conduction angle detection circuit 208. The AC input voltage $AC_{in}$ may be coupled to the rectifier circuit 204 through the optional EMI filter 202. The EMI filter 202 may take a known configuration, such as an inductor and/or capacitor for passing the AC input voltage $AC_{in}$ to the rectifier 204 and filtering EMI-related noise imparted to the output of the phase control dimmer circuit 102. The rectifier circuit 204 may be configured to rectify $AC_{in}$ to provide a rectified output $V_{Rect}$ that is representative of the dimmer setting applied by the phase control dimmer circuit 102. A variety of rectifier circuit configurations are well-known in the art. In some embodiments, for example, the rectifier circuit 204 may include a known bridge rectifier.

The output $V_{Rect}$ of the rectifier circuit 204 may be coupled to the switching converter 205, which may provide a regulated output $V_{reg}$ to the power conversion circuit 206 under the control of the PFC circuit 207. The switching converter 205 may include a switch 209, which may be, but is not limited to, a known transistor switch as is commonly used in known switching converter configurations. The PFC circuit 207 may include a known power factor controller configured to provide a gate drive (GD) output to the switch 209 to control the switch 209 in response to the output $V_{Rect}$ of the rectifier circuit 204 and feedback from the power conversion circuit 206, e.g. feedback representative of the current and voltage output $V_{out}$ to the light source 106. As is known, the GD output from the PFC circuit 207 may control the switch 209 so that the current to the light source 106 has a waveform that substantially matches and is in phase with the output $V_{Rect}$ of the rectifier circuit 204, thereby providing high power factor.

Known PFC circuits useful in a ballast configuration include known integrated circuit power factor correction controllers, such as model number L6561 and L6562 controllers presently available from ST Microelectronics of Sunnyvale, Calif. The L6561 and L6562 controllers may, for example, be employed as a controller in a flyback converter implementation. Details of this and related alternative applications of the L6561 controller are discussed in ST Microelectronics Application Note AN1060, "Flyback Converters with the L6561 PFC Controller," by C. Adragna and G. Garravarik, January 2003, and ST Microelectronics Application Note AN1059, "Design Equations of High-Power-Factor Flyback Converters based on the L6561," by Claudio Adragna, September 2003, each of which is available at http://www.st.com and incorporated herein by reference. Specifically, Application Notes AN1059 and AN1060 discuss one exemplary configuration for an L6561-based flyback converter (High-PF flyback configuration) that operates in transition mode and exploits the ability of the L6561 controller to perform power factor correction, thereby providing a high power factor single switching stage DC-DC converter. Differences between the L6561 and L6562 controllers are discussed in ST Microelectronics Application Note AN1757, "Switching from the L6561 to the L6562," by Luca Salati, April 2004, also available at http://www.st.com and incorporated herein by reference. For purposes of the present disclosure, these two controllers may be discussed as having similar functionality.

The gate drive output of the PFC circuit 207 may also be coupled to the conduction angle detection circuit 208. The conduction angle detection circuit 208 is configured to receive the GD output and provide a voltage-limited dimmer reference level output DIM-REF-LEVEL proportional to the dimmer setting signal. The DIM-REF-LEVEL output of the conduction angle detection circuit 208 is provided to the LIGHT OUTPUT CONTROL input of the power conversion circuit 206.

The power conversion circuit 206 may include a known circuit to receive the output of the switching converter and, in response to the DIM-REF-LEVEL output of the conduction angle detection circuit 208, provides a regulated output $V_{out}$ to the light source 106 to establish a light output level corresponding to the dimmer setting. If the dimmer setting changes, e.g. through user input, the DIM-REF-LEVEL output of the conduction angle detection circuit 208 changes correspondingly, and, in response to such change, the power conversion circuit 206 provides an output $V_{out}$ to the lamp to cause a corresponding change in the light output level of the light source 106.

In general, the power conversion circuit 206 may include a configuration whereby the DIM-REF-LEVEL output to the power conversion circuit may control the current output to the light source 106. In some embodiments, the power conversion circuit 206 may include a known switching inverter, and the DIM-REF-LEVEL output to the power conversion circuit may control the switching frequency of the inverter to control the current output to the light source 106. One known power conversion circuit useful in a ballast circuit consistent with the present disclosure is described in U.S. Pat. No. 6,486,616, the teachings of which are hereby incorporated herein by reference. Other known power conversion circuits useful in a ballast circuit configuration consistent with the present disclosure may include known integrated circuit controllers, such as model number L6574 and L6585 controllers presently available from ST Microelectronics of Sunnyvale, Calif.

Figure 3:
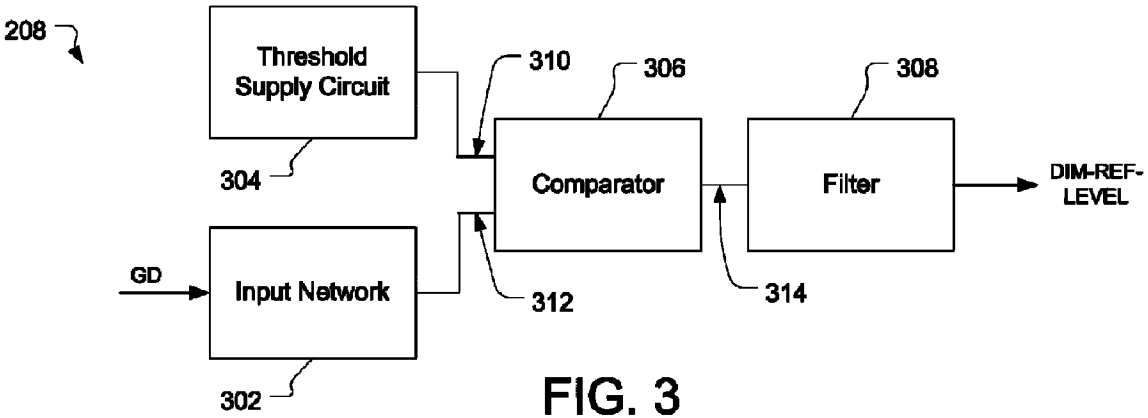
FIG. 3 is a block diagram of a conduction angle detection circuit according to embodiments disclosed herein.

FIG. 3 is a block diagram that conceptually illustrates the functionality of one example of a conduction angle detection circuit 208. As shown, the conduction angle detection circuit 208 may include an input network 302, a threshold supply circuit 304, a comparator 306, and a filter 308. The threshold supply circuit 304 may provide a threshold voltage to a first input 310, e.g. the non-inverting input, of the comparator 306. The input network 302 may receive the GD input from the PFC circuit and provide an output coupled to a second input 312, e.g. the inverting input, of the comparator 306. The output of the input network 302 may ramp up to a voltage level exceeding the threshold voltage only during the dimmer dead time, e.g. during the time when the GD output of the PFC circuit is maintained at a high voltage level, and is limited to the ballast supply voltage, $V_{cc}$. As is known, the supply voltage $V_{cc}$ for operating a ballast, including the components thereof, may be self-supplied in the ballast configuration to ensure a regulated, stable supply to the circuit during operation.

The comparator 306 compares the voltage-limited output of the input network 302 with the threshold voltage provided by the threshold supply circuit 306, and provides a pulse-width modulated output signal having a pulse width proportional to the dimmer setting. The output 314 of the comparator 306 is also limited to a value approximately equal to the supply voltage $V_{cc}$ and is provided to the filter 308. The filter may be a known filter configured to receive the pulse-width modulated output of the comparator 306 and provide the DC output DIM-REF-LEVEL proportional to the dimmer setting signal.

The DIM-REF-LEVEL output provided to the power conversion circuit 206 is thus representative of the dimmer setting and is voltage-limited, e.g. to a voltage approximately equal to the ballast supply voltage $V_{cc}$. Providing a voltage-limited DIM-REF-LEVEL signal allows for good linearity between the dimmer setting and the DIM-REF-LEVEL output and minimizes any impact of variation of in the amplitude of the rectified output $V_{Rect}$ on the DIM-REF-LEVEL output to the power conversion circuit 206. In addition, the voltage-limited DIM-REF-LEVEL output to the power conversion circuit is provided by a relatively simple conduction angle detection circuit 208 that does not include a complex and expensive microcontroller.

Figure 4:
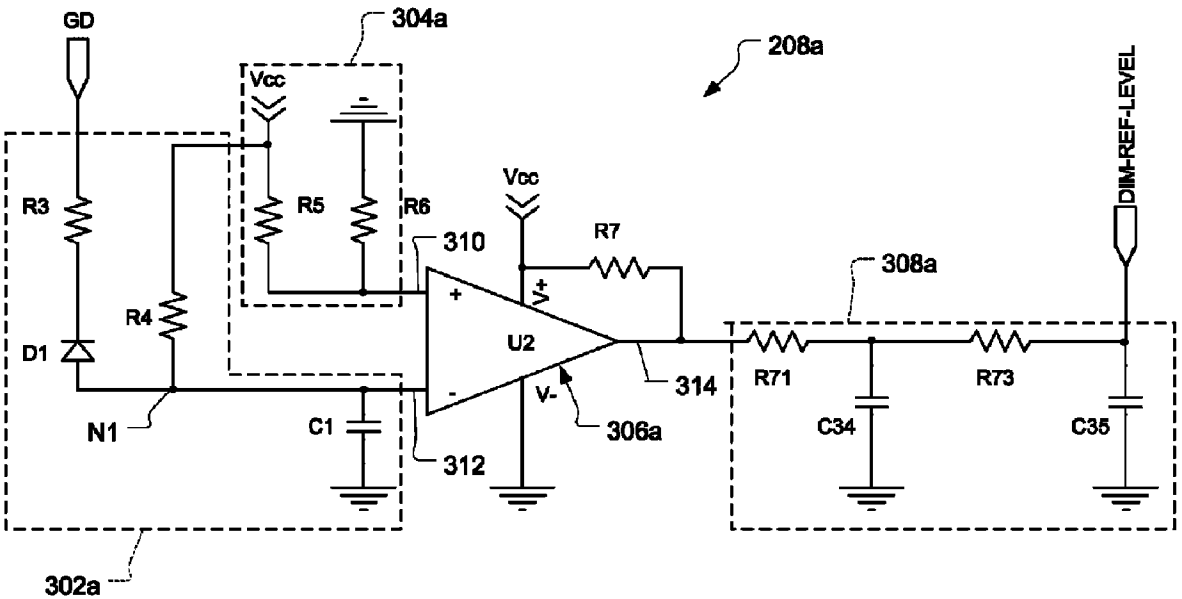
FIG. 4 is a circuit diagram of a conduction angle detection circuit according to embodiments disclosed herein.

Those of ordinary skill in the art will recognize that a conduction angle detection circuit 208 as shown, for example, in FIG. 3 may be realized in a variety of configurations. One such example of a conduction angle detection circuit **208*a* is shown in FIG. 4. The illustrated exemplary embodiment generally includes an input network 302*a*, a threshold supply circuit 304*a*, a comparator 306*a*, a pull-up resistor R7, and a filter 308*a***.

The threshold circuit supply circuit **304*a* includes resistors R5 and R6 in a voltage divider configuration. The supply voltage $V_{cc}$ is coupled across the resistors R5 and R6, and the non-inverting input 310 to the comparator 306*a* is coupled between the resistors R5 and R6. The values of the resistors R5 and R6 thus determine the threshold voltage at the inverting input 312. In some embodiments, for example, the supply voltage $V_{cc}$ may be 15 VDC and the threshold voltage at the input 312** of the comparator may be 5 VDC.

The input network 302*a* includes resistors R3 and R4, a diode D1, and a capacitor C1. The supply voltage $V_{cc}$ is coupled across the resistor R4 and the capacitor C1, with the capacitor C1 coupled to ground and with the resistor R4 and the capacitor C1 coupled to a node N1. The inverting input of the comparator 306*a* is coupled to the capacitor C1 and the node N1. The resistor R3 and the diode D1 are coupled in series to the node N1, with the diode D1 in a reverse bias configuration relative to the inverting input of the comparator. The resistor R3 is coupled to the GD signal, and the diode D1 prevents current from the GD signal from reaching the inverting input 310 of the comparator 306*a*.

In operation, when the GD signal is at a high voltage level, the capacitor C1 is charged by the supply voltage $V_{cc}$ through the resistor R4. However, when the GD signal drops to a low voltage level, the capacitor C1 discharges through the diode D1 and the resistor R3 into the GD output signal network of the PFC circuit 207. The GD signal from the PFC circuit 207 may be maintained at a constant high level during the dimmer dead time, but may switch between high and low voltage level with high frequency, e.g. 20 kHz to 200 kHz, during the dimmer conduction time. To generate a signal representative of the dimmer setting, therefore, the charge time constant associated with the capacitor C1 may be set to a level that prevents the capacitor C1 from charging to a voltage level greater than the threshold voltage at the non-inverting input during the time that the GD signal is switching from high to low voltage levels, even at the longest period of switching in the GD signal. Stated another way, the time constant established by the capacitor C1 and the resistor R4 may be set so that the capacitor C1 charges above the threshold voltage level at the non-inverting input only during the time when the GD signal is being maintained at a high voltage level (i.e. the dimmer dead time).

The comparator 306*a* compares the voltage at the non-inverting 310 and inverting 312 inputs and provides a corresponding output. In particular, the comparator 306*a* provides a high voltage level at its output 314 when the threshold voltage at the non-inverting input 310 has an amplitude greater than the voltage at the inverting input 312, and provides a low voltage level at its output 314 when the threshold voltage at the non-inverting 310 input has an amplitude that is less than the voltage at the inverting input 312. With the output of the input network 302*a* set to exceed the threshold voltage at the non-inverting input 310 only during the dimmer dead time, the comparator 306*a* provides a pulse-width modulated output signal having a pulse-width that is proportional to the dimmer dead time and conduction time, and is thus representative of the dimmer setting. The high voltage level output 314 of the comparator 306*a* is fixed and limited by the comparator 306*a* to the supply voltage $V_{cc}$. The supply voltage $V_{cc}$ is connected through a pull-up resistor R7 to pull the comparator output 314 to its high voltage level after transitioning to a low level.

As shown, the filter 308*a* includes the resistors R71 and R73 and the capacitors C34 and C35 provided in known second order low pass filter configuration. The filter converts the pulse-width modulated output of the comparator 306*a* to the DC output DIM-REF-LEVEL proportional to the dimmer setting.

A conduction angle detection circuit consistent with the present disclosure may be configured to operate with a variety of input voltages based on appropriate selection of various circuit components thereof. Table 1 below identifies one example of circuit components useful in configuring the conduction angle detection circuit 208*a* illustrated in FIG. 4 for operation with a 120V RMs/60 Hz AC source signal $AC_{Source}$ (resistor values in ohms):

TABLE 1

| Component | Descriptor/Value |
|---|---|
| VCC | 15 VDC |
| C1 | 1 nF |
| C34 | 820 nF |
| C35 | 820 nF |
| D1 | 1N4150 |
| R3 | 10 |
| R4 | 820k |
| R5 | 10k |
| R6 | 5k |
| R7 | 1k |
| R71 | 33k |
| R73 | 33k |
| U1 | LM239 |

Figure 5A:
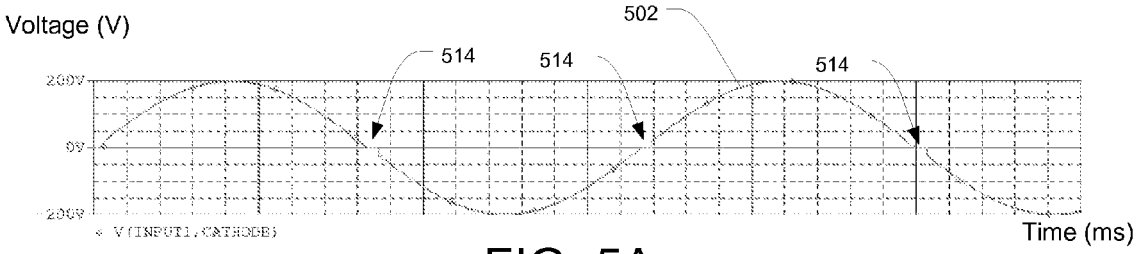
FIG. 5A includes a plot of voltage vs. time of an output of a phase control dimmer circuit with a dimmer setting set at a maximum light output level.
Figure 5B:
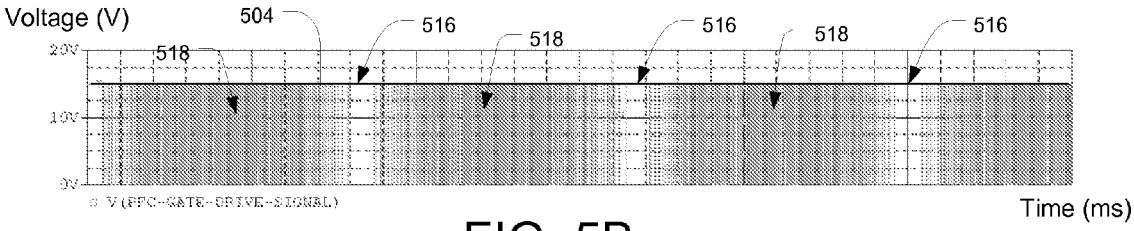
FIG. 5B includes a plot of voltage vs. time of inputs of the gate drive (GD) output of the PFC circuit shown in FIG. 4 and corresponding to the phase control dimmer output shown in FIG. 5A.
Figure 5C:
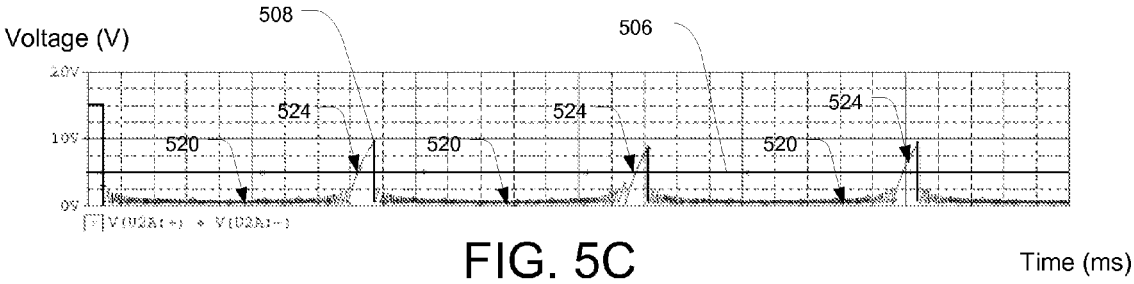
FIG. 5C includes plots of voltage vs. time of the inputs to the comparator of the circuit shown in FIG. 4 corresponding to the phase control dimmer output shown in FIG. 5A.
Figure 5D:
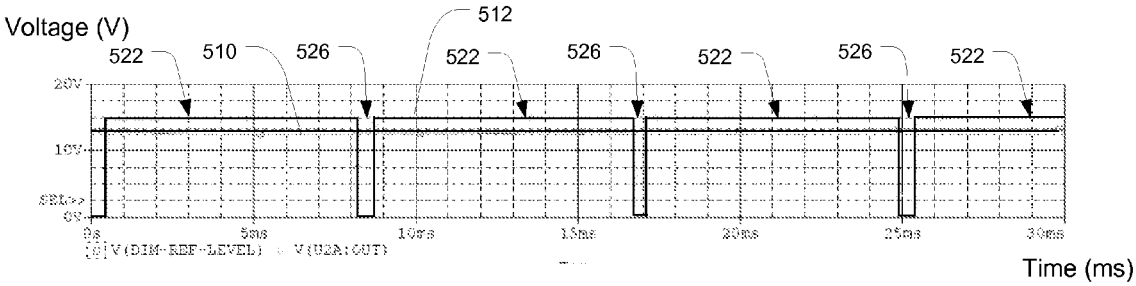
FIG. 5D includes a plots of voltage vs. time of the output of the comparator and the output of the circuit shown in FIG. 4 corresponding to the phase control dimmer output shown in FIG. 5A.

FIGS. 5A-5D include simulated plots of the voltage waveforms associated with the circuit shown in FIG. 4 with component values shown in Table 1 and with a dimmer setting set at a maximum light output level. In particular, FIG. 5A includes a plot 502 of voltage vs. time of the output of a phase control dimmer circuit with a dimmer setting set at a maximum light output level (minimum dead time). FIG. 5B includes a plot 504 of voltage vs. time of the PFC circuit gate drive (GD) signal provided as the input signal to the circuit shown in FIG. 4 corresponding to the maximum dimmer setting shown in FIG. 5A. FIG. 5C includes plots 506, 508 of voltage vs. time of the inputs to the comparator of the circuit shown in FIG. 4 corresponding to the maximum dimmer setting shown in FIG. 5A. FIG. 5D includes plots 510, 512 of voltage vs. time of the output of the comparator and the DIM_REF_LEVEL output of the circuit shown in FIG. 4 corresponding to the maximum dimmer setting shown in FIG. 5A.

With reference to FIG. 5A, when the phase control dimmer is set to provide a maximum light output level, the phase control dimmer output has a minimum dead time shown, for example, in sections 514 of the plot 502. The gate drive signal maintains a constant high voltage level, e.g. 15V, during the phase control dimmer output dead time as shown in sections 516 of the plot 504 in FIG. 5B and switches between high and low voltage levels during the phase control dimmer output conduction time as shown in sections 518 of the plot 504. The threshold voltage at the non-inverting input of the comparator 306*a* is set to about 5V, as shown by the plot 506 of FIG. 5C. As illustrated in sections 520 of the plot 508 in FIG. 5C, during the conduction time (while the GD signal is switching between high and low voltage levels), the capacitor C1 charges and discharges to provide an output to the inverting input of the comparator that does not exceed the threshold voltage at the non-inverting input. During this time period, the comparator provides a high voltage level at its output, as shown in sections 522 of the plot 512 in FIG. 5D. During the dead time as illustrated in sections 524 of the plot 508 in FIG. 5C, however, the capacitor charges to a voltage level that exceeds the threshold voltage at the non-inverting input to the comparator. During this time period, the comparator provides a low voltage level at its output, as shown in sections 526 of the plot 512 in FIG. 5D. The comparator thus produces a pulse-width modulated output having a pulse width proportional to the dimmer setting dead time and conduction time. As illustrated by the plot 510 in FIG. 5D, the DC_RE- F_LEVEL output associated with the maximum light output dimmer setting shown in FIG. 5A is approximately 13.3V.

Figure 6A:
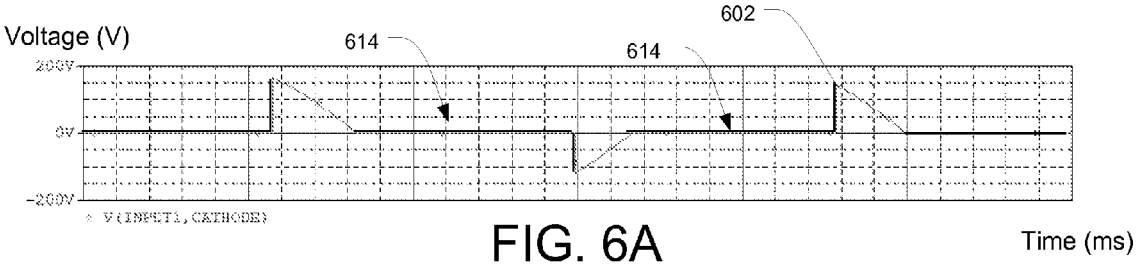
FIG. 6A includes a plot of voltage vs. time of an output of a phase control dimmer circuit with a dimmer setting set at a minimum light output level.
Figure 6B:
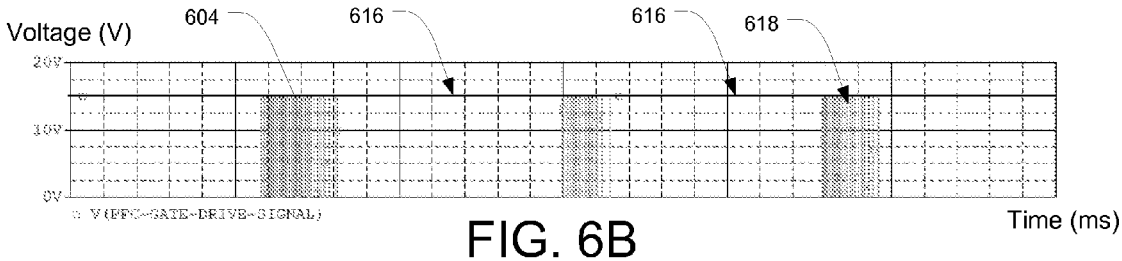
FIG. 6B includes a plot of voltage vs. time of inputs of the gate drive (GD) output of the PFC circuit shown in FIG. 4 and corresponding to the phase control dimmer output shown in FIG. 6A.
Figure 6C:
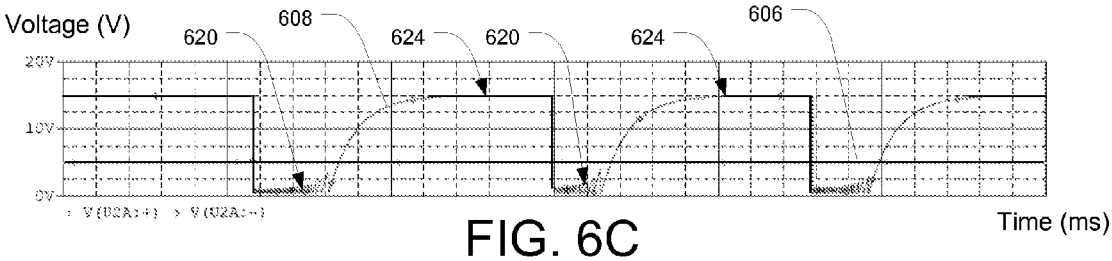
FIG. 6C includes plots of voltage vs. time of the inputs to the comparator of the circuit shown in FIG. 4 corresponding to the phase control dimmer output shown in FIG. 6A.
Figure 6D:
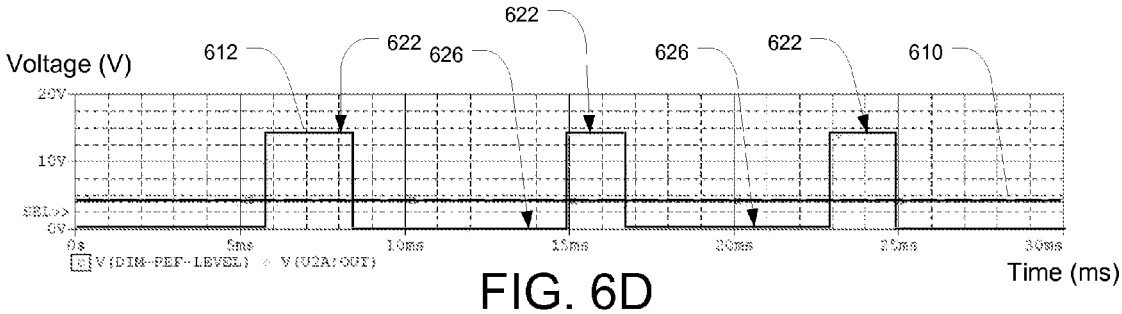
FIG. 6D includes a plots of voltage vs. time of the output of the comparator and the output of the circuit shown in FIG. 4 corresponding to the phase control dimmer output shown in FIG. 6A.

FIGS. 6A-6D include simulated plots of the voltage waveforms associated with the circuit shown in FIG. 4 with component values shown in Table 1 and with a dimmer setting set at a minimum light output level. In particular, FIG. 6A includes a plot 602 of voltage vs. time of the output of a phase control dimmer circuit with a dimmer setting set at a maximum light output level (maximum dead time). FIG. 6B includes a plot 604 of voltage vs. time of the PFC circuit gate drive (GD) signal provided as the input signal to the circuit shown in FIG. 4 corresponding to the minimum dimmer setting shown in FIG. 6A. FIG. 6C includes plots 606, 608 of voltage vs. time of the inputs to the comparator of the circuit shown in FIG. 4 corresponding to the minimum dimmer setting shown in FIG. 6A. FIG. 6D includes plots 610, 612 of voltage vs. time of the output of the comparator and the DIM_REF_LEVEL output of the circuit shown in FIG. 4 corresponding to the minimum dimmer setting shown in FIG. 6A.

With reference to FIG. 6A, when the phase control dimmer is set to provide a minimum light output level, the phase control dimmer output has a minimum dead time shown, for example, in sections 614 of the plot 602. The gate drive signal maintains a constant high voltage level, e.g. 15V, during the phase control dimmer output dead time as shown in sections 616 of the plot 604 in FIG. 5B and switches between high and low voltage levels during the phase control dimmer output conduction time as shown in sections 618 of the plot 604. The threshold voltage at the non-inverting input of the comparator 306*a* is set to about 5V, as shown by the plot 606 of FIG. 6C. As illustrated in sections 620 of the plot 608 in FIG. 6C, during the conduction time (while the GD signal is switching between high and low voltage levels), the capacitor C1 charges and discharges to provide an output to the inverting input of the comparator that does not exceed the threshold voltage at the non-inverting input. During this time period, the comparator provides a high voltage level at its output, as shown in sections 622 of the plot 612 in FIG. 6D. During the dead time as illustrated in sections 624 of the plot 608 in FIG. 6C, however, the capacitor charges to a voltage level that exceeds the threshold voltage at the non-inverting input to the comparator. During this time period, the comparator provides a low voltage level at its output, as shown in sections 626 of the plot 612 in FIG. 6D. The comparator thus produces a pulse-width modulated output having a pulse width proportional to the dimmer setting dead time and conduction time. As illustrated by the plot 610 in FIG. 6D, the DC_REF_LEVEL output associated with the minimum light output dimmer setting shown in FIG. 6A is approximately 4.0V.

Figure 7:
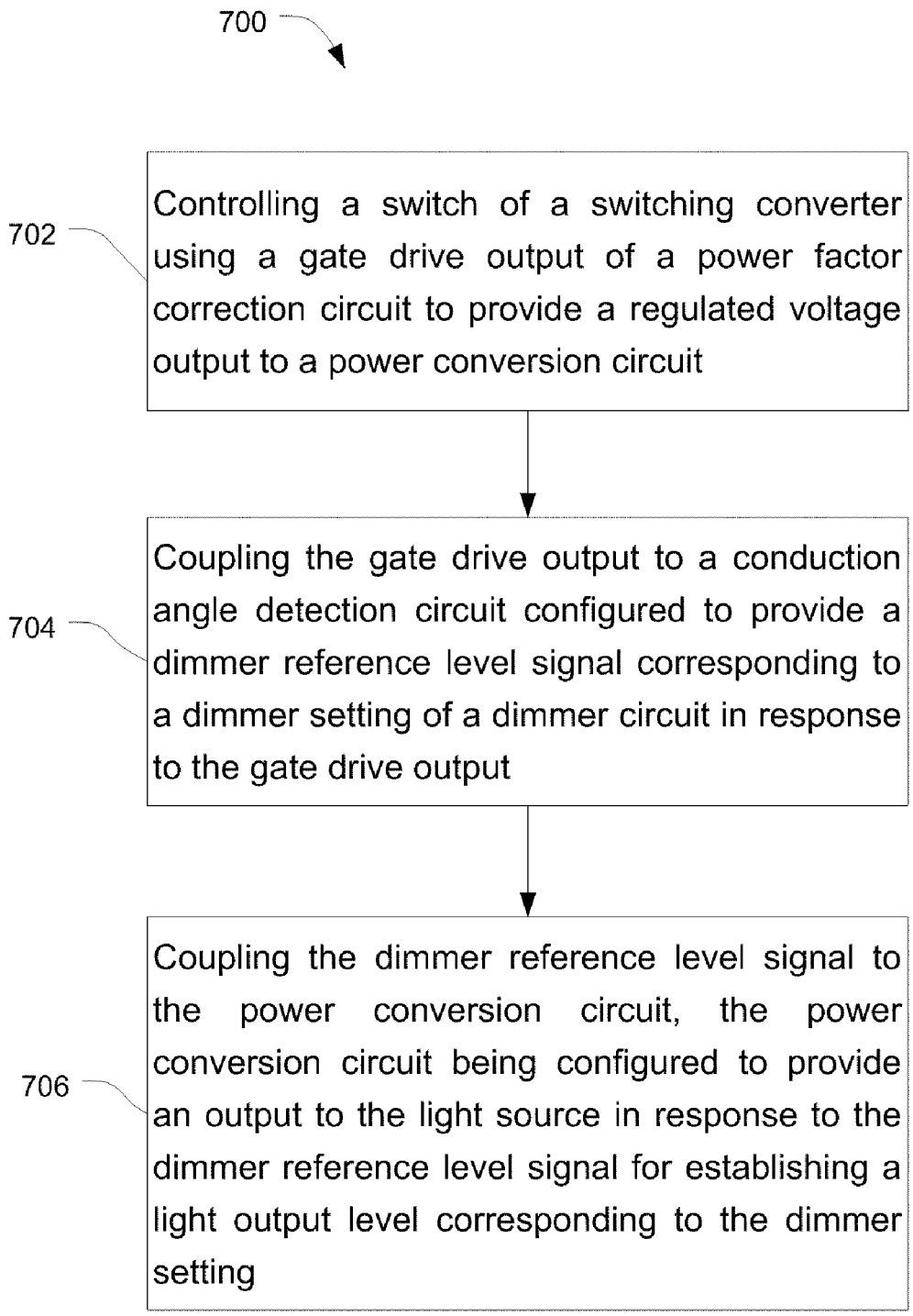
FIG. 7 is a block flow diagram of a method according to embodiments disclosed herein.

FIG. 7 is a block flow diagram of a method 700 of dimming a light source driven by a ballast. The illustrated block flow diagram may be shown and described as including a particular sequence of steps. It is to be understood, however, that the sequence of steps merely provides an example of how the general functionality described herein can be implemented. The steps do not have to be executed in the order presented unless otherwise indicated.

In FIG. 7, a switch of a switching converter is controlled, step 702, using a gate drive output of a power factor correction circuit to provide a regulated voltage output to a power conversion circuit. The gate drive output is coupled, step 704, to a conduction angle detection circuit configured to provide a dimmer reference level signal corresponding to a dimmer setting of a dimmer circuit in response to the gate drive output. The dimmer reference level signal is coupled, step 706, to the power conversion circuit. The power conversion circuit is configured to provide an output to the light source in response to the dimmer reference level signal to establish a light output level corresponding to the dimmer setting.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one, of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A ballast circuit to drive a light source, the ballast circuit comprising:

a rectifier circuit configured to receive an AC input voltage from a dimmer circuit and to provide a rectified output voltage;

a switching converter configured to receive the rectified output voltage and provide a regulated output voltage;

a power factor correction circuit configured to provide a gate drive output to control a switch of the switching converter;

a power conversion circuit configured to receive the regulated output voltage and provide an output to the light source in response to the regulated output voltage and a dimmer reference level signal representative of a dimmer setting of the dimmer circuit; and a conduction angle detection circuit configured to receive the gate drive output and coupled to an input of the power conversion circuit to provide the dimmer reference level signal to the power conversion circuit.

2. The ballast circuit according to claim 1, wherein the conduction angle detection circuit comprises:

a comparator having a first input and a second input, the comparator configured to provide a pulse-width modulated output in response to comparison of signals at the first input with signals at the second input, the pulse width modulated output having a pulse width representative of the dimmer setting of the dimmer circuit;

an input network coupled to the comparator and configured to receive the gate drive signal and to provide an output in response to the gate drive signal, wherein the input network provides the output to the first input of the comparator; a threshold supply circuit configured to provide a threshold voltage to the second input of the comparator; and a filter coupled to the comparator, the filter being configured to convert the pulse-width modulated output of the comparator to the dimmer reference level signal.

3. The ballast circuit according to claim 2, wherein the first input is an inverting input of the comparator and wherein the second input is a non-inverting input of the comparator.

4. The ballast circuit according to claim 2, wherein the input network comprises a capacitor configured to charge during a time when the gate drive signal is at a first level and to discharge during a time when the gate drive signal is at a second level, and wherein a voltage across the capacitor is provided as the output to the first input of the comparator.

5. The ballast circuit according to claim 4, wherein the input network comprises a diode coupled to the capacitor, the diode being configured to block current from the gate drive signal to the first input of the comparator and to allow the capacitor to discharge during the time when the gate drive signal is at the second level.

6. The ballast circuit according to claim 4, wherein the capacitor is configured to charge to a voltage greater than the threshold voltage only during a dead time associated with the dimmer setting.

7. The ballast circuit according to claim 4, wherein the capacitor is configured to be charged by a supply voltage through a resistor.

8. The ballast circuit according to claim 2, wherein the threshold supply circuit comprises first and second resistors provided in a voltage divider configuration, and wherein the second input is coupled between the first and second resistors.

9. The ballast circuit according to claim 2, wherein the filter comprises a second order low pass filter configuration.

10. The ballast circuit according to claim 2, wherein the pulse width modulated signal has a high voltage level limited to a DC value of a supply voltage to the comparator.

11. A conduction angle detection circuit to receive a gate drive signal from a power factor correction circuit and to provide a dimmer reference level signal representative of a dimmer setting of a dimmer circuit in response to the gate drive signal, the conduction angle detection circuit comprising:

a comparator having a first input and a second input, the comparator configured to provide a pulse-width modulated output in response to comparison of signals at the first input with signals at the second input, the pulse width modulated output having a pulse width representative of the dimmer setting of the dimmer circuit;

an input network coupled to the comparator and configured to receive the gate drive signal and to provide an output in response to the gate drive signal, wherein the input network provides the output to the first input of the comparator;

a threshold supply circuit configured to provide a threshold voltage to the second input of the comparator; and a filter coupled to the comparator, the filter being configured to convert the pulse-width modulated output of the comparator to the dimmer reference level signal.

12. The conduction angle detection circuit according to claim 11, wherein the first input is an inverting input of the comparator and the second input is a non-inverting input of the comparator.

13. The conduction angle detection circuit according to claim 11, wherein the input network comprises a capacitor configured to charge during a time when the gate drive signal is at a first level and to discharge during a time when the gate drive signal is at a second level, and wherein a voltage across the capacitor is provided as the output to the first input of the comparator.

14. The conduction angle detection circuit according to claim 13, wherein the input network comprises a diode coupled to the capacitor, the diode being configured to block current from the gate drive signal to the first input of the comparator and to allow the capacitor to discharge during the time when the gate drive signal is at the second level.

15. The conduction angle detection circuit according to claim 13, wherein the capacitor is configured to charge to a voltage greater than the threshold voltage only during a dead time associated with the dimmer setting.

16. The conduction angle detection circuit according to claim 13, wherein the capacitor is configured to be charged by a supply voltage through a resistor.

17. The conduction angle detection circuit according to claim 11, wherein the threshold supply circuit comprises first and second resistors provided in a voltage divider configuration, and wherein the second input is coupled between the first and second resistors.

18. The conduction angle detection circuit according to claim 11, wherein the filter comprises a second order low pass filter configuration.

19. The conduction angle detection circuit according to claim 11, wherein the pulse width modulated signal has a high voltage level limited to a DC value of a supply voltage to the comparator.

20. A method of dimming a light source driven by a ballast, comprising:

controlling a switch of a switching converter using a gate drive output of a power factor correction circuit to provide a regulated voltage output to a power conversion circuit;

coupling the gate drive output to a conduction angle detection circuit, wherein the conduction angle detection circuit is configured to provide a dimmer reference level signal corresponding to a dimmer setting of a dimmer circuit in response to the gate drive output; and coupling the dimmer reference level signal to the power conversion circuit, the power conversion circuit being configured to provide an output to the light source in response to the dimmer reference level signal to establish a light output level corresponding to the dimmer setting.

* * * * *